US005544476A

United States Patent [19]

South et al.

[11] Patent Number: 5,544,476

[45] Date of Patent: Aug. 13, 1996

[54] SAND-TRAP RAKE WITH OPPOSITELY-ANGLED TEETH

[75] Inventors: Robert E. South; Steven J. Petty, both of Warsaw, Ind.

[73] Assignee: Midwest Rake Co., Winona Lake, Ind.

[21] Appl. No.: 379,070

[22] Filed: Jan. 27, 1995

[51] Int. Cl.[6] ..... A01D 7/06

[52] U.S. Cl. ..... 56/400.07; 56/400.21

[58] Field of Search ..... 56/400.21, 400.05, 56/400.07; D8/13

[56] References Cited

U.S. PATENT DOCUMENTS

| | | | |
|---|---|---|---|
| D. 249,013 | 8/1978 | Carman | D8/13 |
| D. 329,785 | 9/1992 | Colonello | D8/13 |
| 1,541,643 | 6/1925 | Hendricks . | |
| 2,030,424 | 2/1936 | Bacigalupi . | |
| 3,440,810 | 4/1969 | Rhyme . | |
| 4,054,313 | 10/1977 | Ciuci | 294/53.5 |
| 4,435,951 | 3/1984 | Dambroth | 56/400.05 |
| 4,595,064 | 6/1986 | Anderson | 172/178 |
| 4,596,113 | 6/1986 | Novoselsky | 56/400.17 X |
| 4,741,150 | 5/1988 | Saksun | 56/400.21 |
| 5,179,825 | 1/1993 | Griffiths et al. | 56/400.05 |

FOREIGN PATENT DOCUMENTS

| | | | |
|---|---|---|---|
| 130766 | 2/1951 | Sweden | 56/400.01 |

OTHER PUBLICATIONS

Tour Smooth Rake, Standard Golf Co., Cedar Falls, IA (Date Unknown).

*Primary Examiner*—Terry L. Melius

*Attorney, Agent, or Firm*—Patent Agent; Wendell E. Miller

[57] ABSTRACT

A rake (10), for smoothing sand surfaces (18A and 18B) in response to pulling the rake (10) along a longitudinal axis (22), includes an elongated head (26) that is disposed transversely to the longitudinal axis (22), and that includes first (52A) and second (52B) pluralities of blades (54A and 54B). Trailing edges (70) of each blade (54A or 54B) are disposed closer to the longitudinal axis (22) than leading edges (68), thereof; so that grains (122A and 122B) of sand are moved transversely inward toward the longitudinal axis (22). The elongated head (26) includes a front curvilinear surface (58) that raises the elongated head (26), a rear curvilinear surface (62) that irons the surface (16), and a flattened portion (66) that floats the elongated head (26) during the raking step.

20 Claims, 2 Drawing Sheets

SAND-TRAP RAKE WITH OPPOSITELY-ANGLED TEETH

BACKGROUND OF THE INVENTION

The present invention relates generally to hand-actuated rakes. More particularly, the present invention relates to rakes for raking sand in the sand traps of golf courses.

FIELD OF THE INVENTION

To meet the challenge of the sport, golfers go to great lengths to pare their scores as close to par as they are able. With this in mind, it is easy to see that removing footprints from the sand, and otherwise preparing the surface of the sand in a sand trap, becomes as important as choosing the correct iron that will be used to drive the ball from the sand trap.

SUMMARY OF THE INVENTION

A rake for smoothing sand-trap surfaces in response to pulling the rake along a longitudinal axis includes an elongated head that is disposed transversely to the longitudinal axis, a handle that is disposed along the longitudinal axis, and both first and second pluralities of blades.

The first plurality of blades is disposed at one angle with respect to the longitudinal axis, and the second plurality of blades is disposed at the opposite angle, so that the first plurality of blades penetrates the surface of the sand, plows the sand, and moves sand inwardly from one end of the elongated head, and the other plurality of blades penetrates the surface of the sand, plows the sand, and moves sand inwardly from the other end of the elongated head.

In a first aspect of the present invention, a rake is provided for plowing, transversely moving, and ironing sand surfaces in response to pulling the rake along a longitudinal axis with a handle thereof inclined upwardly with respect to the longitudinal axis, which rake comprises an elongated head being disposed transversely to the longitudinal axis, and having ends that are disposed on opposite sides of the longitudinal axis; first plowing means, including a first plurality of spaced-apart blades that extend downwardly from the elongated head on one side of the longitudinal axis, for plowing the sand surface in response to the pulling of the rake along the longitudinal axis; second plowing means, including a second plurality of spaced-apart blades that extend downwardly from the elongated head on an opposite side of the longitudinal axis, for plowing the sand surface in response to the pulling of the rake along the longitudinal axis; first transverse moving means, including the first plurality of the blades being disposed at a first angle to the longitudinal axis, for moving grains of sand in the first width in a first transverse direction in response to the plowing of the first width; second transverse moving means, including the second plurality of the blades being disposed at an opposite angle to the longitudinal axis, for moving grains of sand in the second width in a second transverse direction in response to the plowing of the second width; and ironing surface means, including an ironing surface of the elongated head, and including both of the pluralities of the blades being disposed, at least partially, intermediate of the handle and the ironing surface, for ironing the widths subsequent to the plowing and moving.

In a second aspect of the present invention, an elongated bottom portion of an elongated head is provided for a sand-trap rake, which bottom portion comprises a top joining surface having elongated front and rear edges that are disposed generally orthogonal to a vertical plane, and having first and second ends that are disposed on opposite sides of the vertical plane; a curvilinear bottom surface extending between the ends, and curving convexly with respect to the front and rear edges; first and second pluralities of blades being transversely spaced apart between the ends, and extending orthogonally outward from the bottom surface; one of the pluralities of the blades being disposed on one side of the vertical plane and being inclined at a first angle with respect to the vertical plane; the other of the pluralities of the blades being disposed on the opposite side of the vertical plane and being inclined at an opposite angle with respect to the vertical plane; and a rear curvilinear surface of the curvilinear bottom surface that extends rearwardly from both of the pluralities of the blades.

In a third aspect of the present invention, a method is provided for smoothing sand surfaces in sand traps, which method comprises plowing a first longitudinally-extending width of a sand surface; plowing a second longitudinally-extending width of the sand surface; moving grains of sand in the first width transversely in one direction in response to the first plowing step; moving grains of sand in the second width transversely in an opposite direction in response to the second plowing step; and ironing the first and second widths into a contiguous sand surface subsequent to all of the aforesaid steps.

In a fourth aspect of the present invention, a rake is provided for granular material, which rake comprises an elongated head having first and second ends that are disposed on opposite sides of a longitudinal axis, and having an ironing surface with a line of contact that extends between the ends of the elongated head; a handle being disposed along the longitudinal axis and being attached to the elongated head; means, including first and second pluralities of spaced-apart plow blades that extend downwardly from the elongated head on opposite sides of the longitudinal axis, for plowing the granular material; means, including the first and second pluralities of blades being inclined at opposite angles to the longitudinal axis, for moving the granular material on the opposite sides of the longitudinal axis in opposite transverse direction; and means, including the ironing surface being disposed rearwardly of the blades, for ironing the granular material subsequent to the plowing and transversely moving.

In a fifth aspect of the present invention, a method is provided for smoothing a surface of granular material, which method comprises moving grains of the granular material, that are disposed in a first longitudinally-extending width, in one transverse direction in response to longitudinal plowing of the first longitudinally-extending width; moving grains of the granular material, that are disposed in a second longitudinally-extending width, in an opposite transverse direction in response to longitudinal plowing of the second longitudinally-extending width; and ironing the first and second widths into a contiguous surface subsequent to both of the plowing steps and both of the moving steps.

DESCRIPTION OF THE PREFERRED EMBODIMENTS

Figure 1:
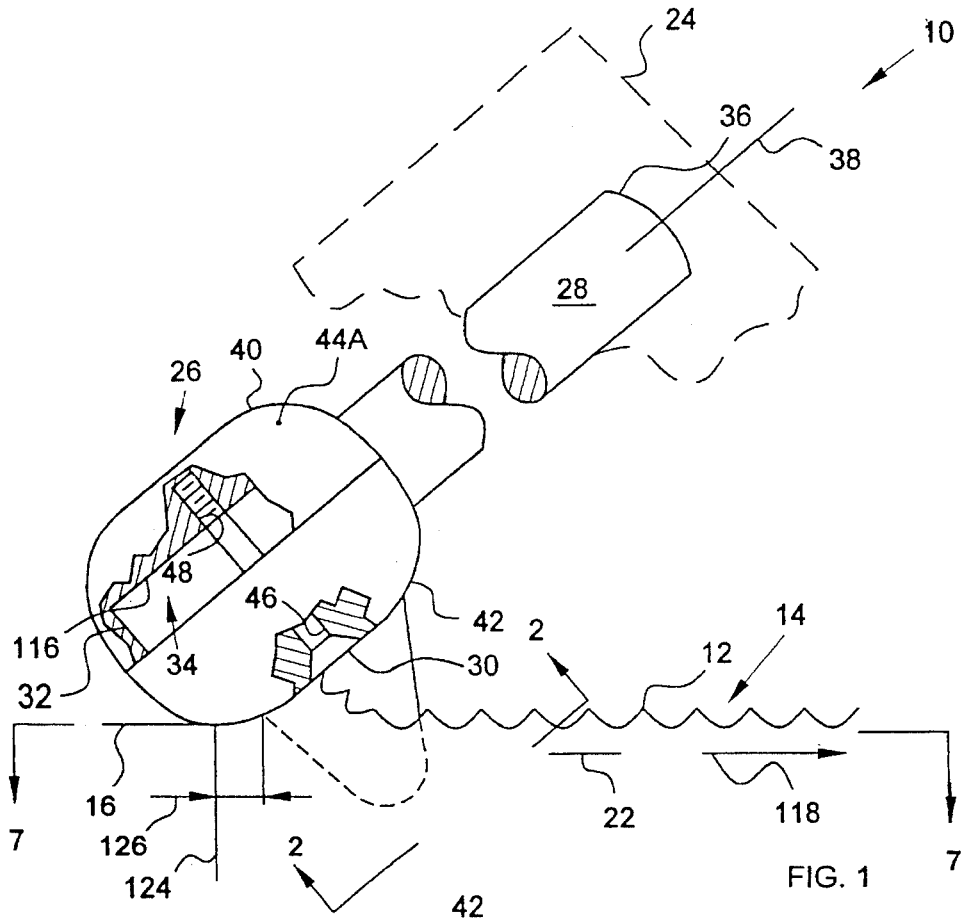
FIG. 1 is a side elevation of the sand-trap rake of the present invention, with a handle inserted between elongated top and bottom portions, with partial cross-sections showing assembly details, and with surfaces of the sand, both raked and unraked, shown.
Figure 7:
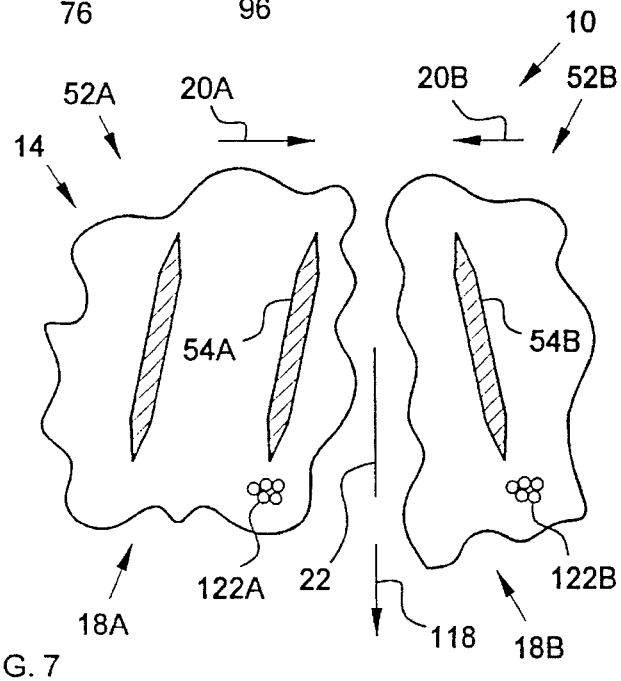
FIG. 7 is a top view, taken substantially as shown by view line 7—7 of FIG. 1, but rotated from standard position, showing sand being moved transversely inward from ends of the rake.

Referring now to FIGS. 1 and 7, a sand-trap rake 10 smooths an irregular surface, or roughened surface, 12 of a sand trap 14 into a smoothed and contiguous sand surface 16. This smoothing of the irregular surface 12 includes moving a first sand surface 18A in a first transverse direction 20A, and moving a second sand surface 18B in a second and opposite transverse direction 20B, as shown in FIG. 7, in response to pulling the rake 10 along a longitudinal axis 22 that is disposed in a vertical plane 24.

Continuing to refer to FIG. 1, the rake 10 includes an elongated head 26, a handle 28, and a self-tapping screw 30.

A first end 32 of the handle 28 is disposed in a handle opening 34 of the elongated head 26, and a second end 36 of the handle 28 is disposed distal from the handle opening 34. Both the handle 28 and the handle opening 34 are disposed along a handle axis, or handle opening axis, 38 that is in the vertical plane 24. In normal use, depending somewhat upon the height of the user, the handle axis 38 is disposed about 40 degrees above the longitudinal axis 22.

Figure 2:
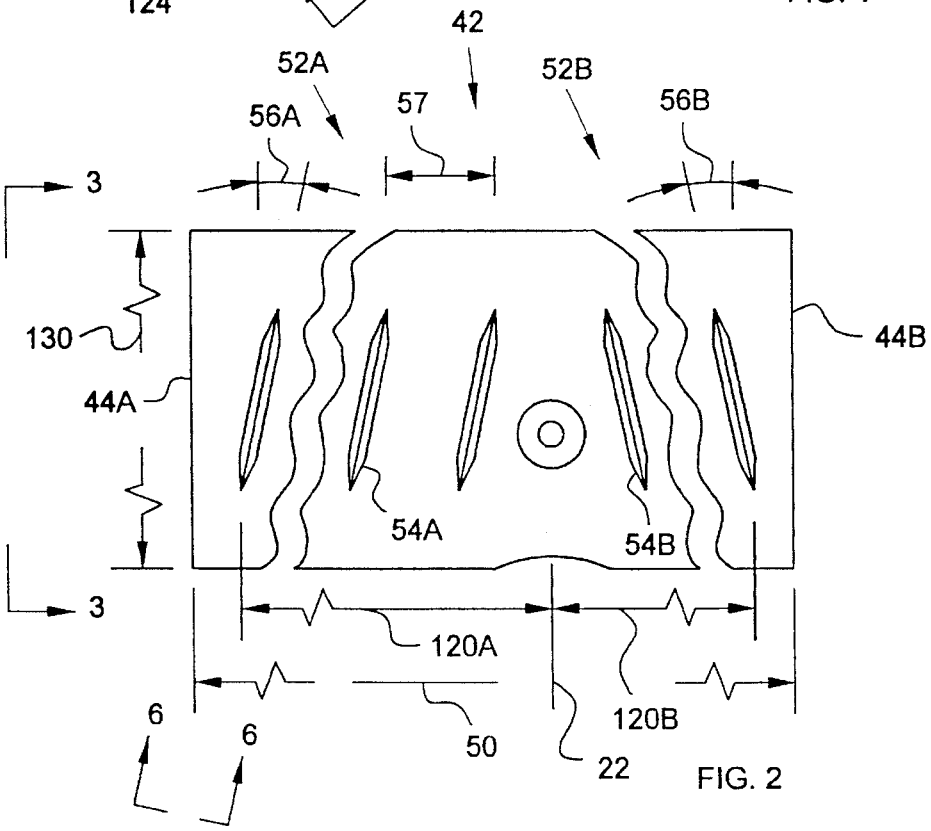
FIG. 2 is a bottom view of the bottom portion of the rake of FIG. 1, taken substantially as shown by view line 2—2 of FIG. 1, but rotated from standard position, showing first and second pluralities of teeth disposed on opposite sides of a longitudinal axis and disposed at opposite angles with respect to the longitudinal axis.
Figure 3:
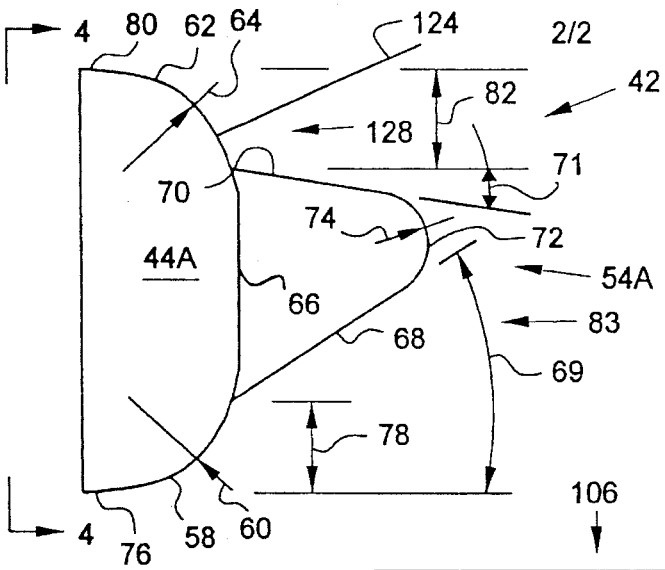
FIG. 3 is an end view of the bottom portion of FIG. 2, taken substantially as shown by view line 3—3 of FIG. 2.

Referring now to FIGS. 1–3, the elongated head 26 includes an elongated top portion 40 and an elongated bottom portion 42. The elongated head 26 includes first and second ends 44A and 44B, and the top and bottom portions, 40 and 42, include like-numbered ends.

Referring again to FIG. 1, the self-tapping screw 30 is inserted through a countersunk hole 46 in the elongated bottom portion 42, retainingly pierces the handle 28, and taps into a screw-starting hole 48 in the elongated top portion 40, thereby both securing the elongated top and bottom portions, 40 and 42, together, and securing the handle 28 in the handle opening 34.

Referring now to FIGS. 1 and 2, and more particularly to FIG. 2, the elongated bottom portion 42 includes an elongated dimension 50 that extends between the ends 44A and 44B, and the ends 44A and 44B are equidistant from the longitudinal axis 22, the handle axis 38, and the vertical plane 24.

A first plurality 52A of individual teeth, or spaced-apart plow blades, 54A are disposed at a first angle 56A with respect to the longitudinal axis 22 and the vertical plane 24, and a second plurality 52B of individual teeth, or spaced-apart plow blades, 54B are disposed at a second, opposite, and substantially equal angle 56B. Each of the blades 54A or 54B are spaced from each other at a distance 57.

Referring now to FIG. 3, the elongated bottom portion 42 includes a first curvilinear surface, or front curvilinear surface, 58 having a front radius 60, a second curvilinear surface, or rear curvilinear surface, or ironing surface, 62 having a rear radius 64, and a flattened portion, or differently-shaped surface, 66 that is disposed between the curvilinear surfaces 58 and 62.

The teeth, or blades, 54A and 54B, each include a leading edge 68 that is tapered at a first angle 69, a trailing edge 70 that is tapered at a smaller angle 71, and a curved end 72 having a radius 74. The leading edges 68 of the blades 54A and 54B are set back from an elongated front edge 76 of the elongated bottom portion 42 by a dimension 78, and the trailing edges 70 of the blades 54A and 54B are disposed in front of an elongated rear edge 80 of the elongated bottom portion 42 by a dimension 82. The first curvilinear surface 58, the second curvilinear surface 62, and the flattened portion 66 combine to form a curvilinear bottom surface 83 that extends between the ends 44A and 44B and curves convexly with respect to the front 76 and rear 80 edges.

Figure 6:
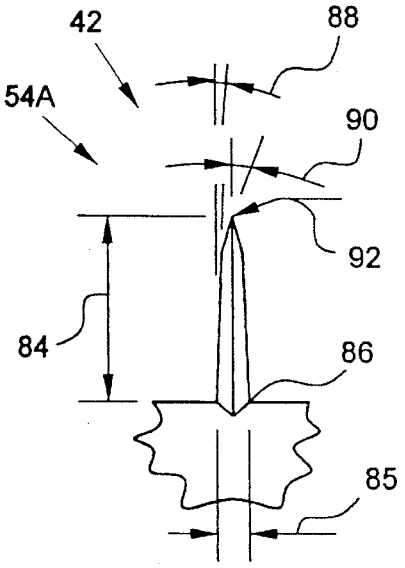
FIG. 6 is an edge profile of a tooth taken substantially as shown by view line 6—6 of FIG. 2.

Referring now to FIG. 6, the blade 54A includes a height 84, a width, or thickness, 85 at a base 86, a draft angle 88, a sharpening angle 90, and a tip and edge radius 92. The tip and edge radius 92 extends along the leading edge 68, the curved end 72, and the trailing edge 70 of FIG. 3. The blade 54B includes like-named, like-numbered, and like-dimensioned parts as the blade 54A.

Although in FIG. 3 the blade 54A is not shown at an angle to the plane of the paper, dimensions as included herein pertain to true profiles of the individual teeth 54A and 54B.

Figure 4:
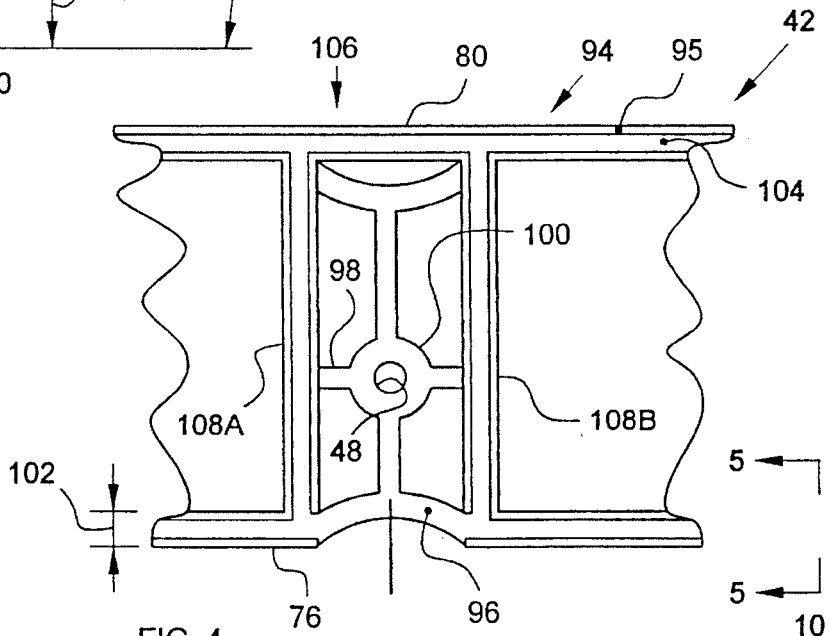
FIG. 4 is a partial plan view of the inside of the bottom portion of FIGS. 2 and 3, taken substantially as shown by view line 4—4 of FIG. 3, and showing handle-receiving details.

Referring now to FIG. 4, the elongated bottom portion 42 includes a peripheral flange 94 with a top joining surface, or elongated joining surface, 95, and a semi-cylindrical surface, or semi-cylindrical opening, or semi-cylindrical shape, 96. The semi-cylindrical surface 96 includes ribs 98, a screw-receiving boss 100, and the screw-starting hole 48. The peripheral flange 94 has a width 102, and extends along the front edge 76, the rear edge 80, and the first and second ends, 44A and 44B of FIG. 2.

Figure 5:
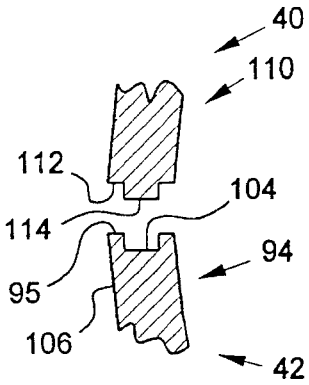
FIG. 5 is a partial cross section of the bottom and top portions, with the bottom portion taken substantially as shown by view line 5—5 of FIG. 4, and with the top portion taken substantially the same as the bottom portion, but separated therefrom.

Referring now to FIGS. 4 and 5, the peripheral flange 94 of the bottom portion 42 includes a tang-receiving groove 104 that is disposed inside a periphery 106 of the bottom portion 42, that extends around the periphery 106 except for the semi-cylindrical surface 96, and that extends along sides 108A and 108B of the semi-cylindrical surface 96.

Continuing to refer to FIG. 5, a matching peripheral flange 110 of the elongated top portion 40 of FIG. 1 includes a surface 112 with a tang 114 that matches the tang-receiving groove 104 of the bottom portion 42. As seen only in FIG. 1, the elongated top portion 40 includes a semi-cylindrical surface, or semi-cylindrical opening, 116; so that the semi-cylindrical surfaces 96 of FIG. 4 and 116 of FIG. 1 combine to form the handle opening 34.

The tang 114 and the tang-receiving groove 104 cooperate to prevent all transverse movement between the elongated top portion 40 and the elongated bottom portion 42.

Referring now to FIGS. 1 and 7, and more particularly to FIG. 7, with the rake 10 being drawn along the longitudinal axis 22 in a pulling direction 118 by the handle 28, the first plurality 52A of blades 54A penetrates the first sand surface 18A as shown in FIG. 1, plows the granular material 122A, and by virtue of the angle 66A, moves the first sand surface 18A transversely inward in the first direction 20A, from the end 44A of FIG. 2 toward both the longitudinal axis 22 and the handle axis 38 of FIG. 1, and the second plurality 52B of blades 54B penetrates the second sand surface 18B as shown in FIG. 1, plows the granular material 122B, and by virtue of the angle 56B, moves the second sand surface 18B transversely inwardly in the second direction 20B, from the end 44B of FIG. 2 toward the longitudinal axis 22 and the handle axis 38.

Referring again to FIGS. 1 and 3, the front curvilinear surface 58 and/or the flattened portion 66 provide(s) lifting means for lifting the rake 10 as the elongated head 26 encounters the roughened surface 12. That is, depending upon the height of the user and the angle between the handle axis 38 and the longitudinal axis 22, the front curvilinear surface 58 and/or the flattened portion 66 provide(s) the lifting means.

The rear curvilinear surface 62 provides an ironing function, ironing the sand surfaces 18A and 18B of FIG. 7 into the smoothed and contiguous sand surface 16 subsequent to a step in which the pluralities 52A and 52B of the teeth 54A and 54B move the sand surfaces 18A and 18B transversely inward.

As seen in FIGS. 1, 3, and 7, for the ironing step, the principal line of contact of the rear curvilinear surface 62 is a line of contact 124 that is disposed rearward of the teeth 54A and 54B by a dimension 126. Therefore, in terms of methods steps, the ironing step follows the step of transversely moving the sand surfaces 18A and 18B inwardly.

The flattened portion 66, and/or a part 128 of the rear curvilinear surface 62 that lies between the flattened portion 66 and the line of contact 124, provide(s) float means for floating the elongated head 26.

Pertinent dimensions of the preferred configuration are: elongated dimension 50=381.0 mm; angles 56A and 56B= 15.00 degrees; distance 57=20.57 mm; front radius 60=22.98 mm; rear radius 64=22.98 mm; edge angle 69=34.0 degrees; edge angle 71 =6.0 degrees; radius 74=9.188 mm; dimension 78=14.26 mm; dimension 82=12.70 mm; blade height 84=28.58 mm; blade width 85=3.962 mm; draft angle 88=1.5 degrees; sharpening angle 90=12.13 degrees; tip and edge radius 92=0.010 mm, maximum; flange width 102=2.286 mm; and an elongated head width 130=15.88 mm.

In the preferred configuration as described above, the elongated head 26 is straight, as opposed to being curved or angled, extends transversely outward from the handle axis 38 at an angle of 90 degrees and has an elongated head width 13. Preferably, the blades 54A and 54B and 54B are straight, but disposed at the angles, 56A and 56B of FIG. 2. Preferably, both of the pluralities 52A and 52B of the blades 54A and 54B, are disposed to move the sand surfaces 18A and 18B inwardly. And, preferably, the angles 56A and 56B of the blades 54A and 54B are equal for each of the blades 54A and 54B.

Since the teeth, 54A and 54B, the front curvilinear surface 58, the rear curvilinear surface 62, and the flattened portion 66 are integrally molded as a part of the elongated bottom portion 42, and since separate ones of these members, or combinations of these members, as previously discussed, provide means for lifting, floating, plowing, moving, and ironing, it is correct to say that the means for lifting, floating, plowing, moving, and ironing comprises rigidly interconnected members.

Referring to FIGS. 1, 2, and 7, the method of the present invention includes simultaneously raking a first transverse width, or first longitudinally-extending width, or first longitudinally-disposed as portion, 120A and a second transverse width, or second, or adjacent, longitudinally-extending width or second longitudinally-disposed portion, 120B, of the first and second sand surfaces, 18A and 18B, moving granular material, or grain 122A and 122B of sand from the sand surfaces 18A and 18B transversely toward each other, and ironing the sand surfaces 18A and 18B into the smoothed and contiguous sand surface 16. The method of the present invention further comprises lifting the elongated head 26 and floating the elongated head 26.

For purposes of understanding the claims, where an order of sequence is recited, the recited order is the same as any continuous process. That is, the step of floating precedes the step of ironing for the longitudinally-disposed portions 120A and 120B of the sand surfaces 18A and 18B. More importantly, the step of ironing follows the steps of moving the sand surfaces 18A and 18b transversely inward.

However, as can be seen by inspection of FIG. 1, the transversely moving steps, as achieved by the teeth 52A and 52B, are substantially concurrent with the floating step that is achieved, at least in part, by the flattened portion 66.

The blades 54A and 54B, and the angles 56A and 56B, thereof of FIG. 2, provide means for moving the grains 122A and 122B of sand in the first and second transverse directions, 20A and 20B, in response to movement of the rake 10 along the longitudinal axis 22. Preferably, the directions 20A and 20B of transverse movement are inwardly of the ends 44A and 44B of FIG. 2, toward the longitudinal axis 22.

Further, referring to FIGS. 1–3, the means for moving the grains 122A and 122B of sand of FIG. 7 transversely includes the trailing edges 70 of the blades 54A and 54B being disposed at different distances from the ends 44A and 44B of the elongated head 26, than the leading edges 68 thereof.

Preferably, the trailing edges 70 are closer to the longitudinal axis 22 than the leading edges 68, so that the longitudinally-disposed portions, 120A and 120B of FIG. 7, of the sand surfaces 18A and 18B are moved transversely inward toward the longitudinal axis 22.

While specific apparatus and method have been disclosed in the preceding description, and while part numbers have been inserted parenthetically into the claims to facilitate understanding of the claims, it should be understood that these specifics have been given for the purpose of disclosing the principles of the present invention and that many variations thereof will become apparent to those who are versed in the art. Therefore, the scope of the present invention is to be determined by the appended claims, and without any limitation by the part numbers inserted parenthetically in the claims.

Industrial Applicability

The present invention is applicable for use in redistributing granular material, and for smoothing the surfaces of granular material, such as sand in sand traps, by transversely distributing grains of the granular material in response to longitudinal movement of a rake.

What is claimed is:

1. A rake (10) for plowing, transversely moving, and ironing sand surfaces (18A and 18B) in response to pulling said rake along a longitudinal axis (22) with a handle (28) thereof inclined upwardly with respect to said longitudinal axis, which rake comprises:

an elongated head (26) being disposed transversely to said longitudinal axis, and having ends (44A and 44B) that are disposed on opposite sides of said longitudinal axis;

first plowing means, comprising a first plurality (52A) of spaced-apart blades (54A) that extend downwardly from said elongated head on one side of said longitudinal axis, for plowing said sand surface (18A) in response to said pulling of said rake along said longitudinal axis;

second plowing means, comprising a second plurality (52B) of spaced-apart blades (54B) that extend downwardly from said elongated head on an opposite side of said longitudinal axis, for plowing said sand surface (18B) in response to said pulling of said rake along said longitudinal axis;

first transverse moving means, comprising said first plurality of said blades being disposed at a first angle (56A) to said longitudinal axis, for moving grains (122A) of sand in a first width in a first transverse direction (20A) in response to said plowing of said first width;

second transverse moving means, comprising said second plurality of said blades being disposed at an opposite angle (56B) to said longitudinal axis, for moving grains (122B) of sand in a second width in a second transverse direction (20B) in response to said plowing of said second width; and ironing surface means, comprising an ironing surface (62) of said elongated head, and comprising both of said pluralities of said blades being disposed, at least partially, intermediate of said handle and said ironing surface, for ironing said widths subsequent to said plowing and moving.

2. A rake (10) as claimed in claim 1 in which both of said transverse directions (20A and 20B) are toward said longitudinal axis (22).

3. A rake (10) as claimed in claim 1 in which said ironing surface (62) comprises a curvilinear surface (62), and said elongated head (26) further comprises lifting surface means comprising a surface (66) that is shaped differently than said ironing surface (62), for guiding said rake over a roughened surface (12).

4. A rake (10) as claimed in claim 1 in which said ironing surface (62) comprises a curvilinear surface (62), and said elongated head (26) further comprises:

lifting surface means, comprising another curvilinear surface (58), for assisting in guiding said rake over a roughened surface (12); and float-surface means, comprising a differently-shaped surface (66) that is disposed intermediate of said curvilinear surfaces, for floating said elongated head.

5. A rake (10) as claimed in claim 1 in which said elongated head (26) comprises an elongated top portion (40) and an elongated bottom portion (42); and said rake includes means, comprising semi-cylindrical openings (96 and 116) in said portions, for clamping said handle (28) between said top and bottom portions.

6. An elongated bottom portion (42) of an elongated head (26) for a sand-trap rake (10), which bottom portion comprises:

a top joining surface (95) having elongated front (76) and rear (80) edges that are disposed generally orthogonal to a vertical plane (24), and having first (44A) and second (44B) ends that are disposed on opposite sides of said vertical plane;

a curvilinear bottom surface (83) extending between said ends, and curving convexly with respect to said front and rear edges;

first (52A) and second (52B) pluralities of blades (54A and 54B) being transversely spaced apart between said ends, and extending orthogonally outward from said bottom surface;

one (52A) of said pluralities of said blades (54A) being disposed on one side of said vertical plane and being inclined at a first angle (56A) with respect to said vertical plane;

the other (52B) of said pluralities of said blades (54B) being disposed on the opposite side of said vertical plane and being inclined at an opposite angle (56B) with respect to said vertical plan; and said curvilinear bottom surface including a rear curvilinear surface (62) that extends rearwardly from both of said pluralities of said blades.

7. An elongated bottom portion (42) as claimed in claim 6 in which:

said pluralities (52A and 52B) of said blades comprise individual blades (54A and 54B) each including a base (86) having a width (85), a curved end (72) being smaller than said width, a leading edge (68) that is tapered at a first angle (69), and a trailing edge (70) that is tapered at a smaller angle (71); and said curved ends of said blades are disposed closer to said elongated rear edge (80) than to said elongated front edge (76).

8. An elongated bottom portion (42) as claimed in claim 6 in which said curvilinear bottom surface (83) includes lifting surface means, comprising a front curvilinear surface (58) that is proximal to said elongated front edge (76), for lifting said elongated head (26); and ironing surface means, comprising said rear curvilinear surface (62) that is disposed proximal to said elongated rear edge (80), for ironing sand surfaces (18A and 18B) into a smoothed surface (16).

9. An elongated bottom portion (42) as claimed in claim 8 in which said curvilinear bottom surface (83) further comprises float-surface means, comprising a flattened portion (66), that is disposed intermediate of said front (58) and rear (62) curvilinear surfaces.

10. An elongated bottom portion (42) as claimed in claim 6 in which said bottom portion includes handle opening means (34), comprising a semi-cylindrical shape (96), and having a handle opening axis (38) that coincides with said top joining surface (95);

said curvilinear bottom surface (83) comprises a front curvilinear surface (58) that is proximal to said elongated front edge (76), and a flattened portion (66) that is intermediate of said front and rear curvilinear surfaces;

said pluralities (52A and 52B) of blades comprise individual blades (54A and 54B) each including a base (86) having a width (85), a curved end (72) being smaller than said width, a leading edge (68) that is tapered at a first angle (69), and a trailing edge (70) that is tapered at a smaller angle (71); and said curved ends of said blades are disposed closer to said elongated rear edge than to said elongated front edge.

11. A method for smoothing sand surfaces in sand traps, which method comprises:

a) plowing a first longitudinally-extending width of a sand surface;

b) plowing a second longitudinally-extending width of said sand surface;

c) moving grains of sand in said first width transversely in one direction in response to the first said plowing step;

d) moving grains of sand in said second width transversely in an opposite direction in response to the second said plowing step; and e) ironing said first and second widths into a contiguous sand surface subsequent to all of the aforesaid plowing and moving steps, said plowing, moving and ironing steps being performed by rigidly interconnected members.

12. A method as claimed in claim 11 in which:

a) said plowing steps are performed substantially simultaneously with each other;

b) said moving steps are performed substantially simultaneously with each other and with said plowing steps; and c) both of said directions are toward a longitudinal axis that is disposed intermediate of said longitudinally-extending widths.

13. A method as claimed in claim 11 in which said plowing steps comprise pulling, and said method further comprises:

a) automatically lifting an elongated head in response to said pulling step; and b) automatically floating said elongated head in response to said pulling step.

14. A method as claimed in claim 12 in which said plowing steps comprise pulling, and said method further comprises:

a) automatically lifting an elongated head in response to said pulling step; and b) automatically floating said elongated head in response to said pulling step.

15. A rake (10) for granular material (122A and 122B), which rake comprises:

an elongated head (26) having first (44A) and second (44B) ends that are disposed on opposite sides of a longitudinal axis (22), and having an ironing surface (62) with a line of contact (124) that extends between said ends of said elongated head;

a handle (28) being disposed along said longitudinal axis and being attached to said elongated head;

means, comprising first (52A) and second (52B) pluralities of spaced-apart plow blades (54A and 54B) that extend downwardly from said elongated head on opposite sides, respectively, of said longitudinal axis, for plowing said granular material;

means, comprising said first and second pluralities of blades being inclined at opposite angles (56A and 56B) to said longitudinal axis, for moving said granular material on said opposite sides of said longitudinal axis in opposite transverse directions (20A and 20B); and means, comprising said ironing surface being disposed rearwardly of said blades, for ironing said granular material subsequent to said plowing and transversely moving of said granular material.

16. A rake (10) as claimed in claim 15 in which said ironing surface comprises a curvilinear ironing surface (62); and said rake includes means, comprising a differently-shaped surface (66) for floating said elongated head (26).

17. A rake (10) as claimed in claim 15 in which said ironing surface comprises a curvilinear ironing surface (62), and said rake further comprises:

means, including another curvilinear surface (58) for lifting said elongated head; and means, including a differently-shaped surface (66) that is interposed between said curvilinear surfaces, for floating said elongated head.

18. A method for smoothing a surface of granular material, which method comprises:

a) moving grains of said granular material, that are disposed in a first longitudinally-extending width, in one transverse direction in response to longitudinal plowing of said first longitudinally-extending width;

b) moving grains of said granular material, that are disposed in a second longitudinally-extending width, in an opposite transverse direction in response to longitudinal plowing of said second longitudinally-extending width; and c) ironing said first and second widths into a contiguous surface subsequent to both of said plowing steps and both of said moving steps, said moving and ironing steps being performed by rigidly interconnected members.

19. A method as claimed in claim 18 in which:

a) said method further comprises lifting of said rigidly interconnected members; and b) said ironing and lifting steps comprise separate curvilinear surfaces of said rigidly interconnected members.

20. A method as claimed in claim 18 in which:

a) said method further comprises lifting and floating of said rigidly interconnected members;

b) said ironing and lifting steps comprise separate curvilinear surfaces of said rigidly interconnected members; and c) said floating step comprises a differently shaped surface of said rigidly interconnected members.

* * * * *

UNITED STATES PATENT AND TRADEMARK OFFICE

CERTIFICATE OF CORRECTION

PATENT NO. : 5,544,476

DATED : 13 August 1996

INVENTOR(S) : Robert E. South et al.

It is certified that error appears in the above-indentified patent and that said Letters Patent is hereby corrected as shown below:

In column 5, "66A" should be --56A-- in line 4. In column 5, "13" should be --130-- in line 54. In column 6, "as" should be deleted from line 6. In col. 8 Claim 6, "plan" should be --plane-- in line 18.

Signed and Sealed this

Third Day of December, 1996

Bruce Lehman

*Attest:*

BRUCE LEHMAN

*Attesting Officer*

*Commissioner of Patents and Trademarks*